US005386750A

United States Patent [19]

Morrison

[11] Patent Number: 5,386,750

[45] Date of Patent: Feb. 7, 1995

[54] REMOVABLE COMB ATTACHMENT FOR DISPOSABLE RAZORS

[76] Inventor: David J. Morrison, 2123 W. Isthmus Loop, Mesa, Ariz. 85202

[21] Appl. No.: 28,289

[22] Filed: Mar. 9, 1993

[51] Int. Cl.[6] ..... B26B 21/12

[52] U.S. Cl. ..... 83/13; 30/31

[58] Field of Search ..... 83/13; 30/31, 30, 41, 30/346.56

[56] References Cited

U.S. PATENT DOCUMENTS 1,227,548 5/1917 Carlisle ..... 30/31
2,171,880 9/1939 Lewis ..... 30/31
2,588,033 3/1952 O'Gatty ..... 30/31
2,782,499 2/1957 Grey ..... 30/31
4,535,537 8/1985 Ferraro et al. ..... 30/41

*Primary Examiner*—Richard K. Seidel
*Assistant Examiner*—Kenneth E. Peterson

[57] ABSTRACT

A detachable hair-trimming attachment for a disposable safety razor which has a frame and a plurality of spaced, parallel teeth which extend above and perpendicular to the razor blade. The frame has an opening which exposes the blade to hair to be trimmed, the hair being guided to the blades by the teeth. The frame is designed with detachable fasteners which engage corresponding interengaging fasteners on the shaving head of the razor.

25 Claims, 5 Drawing Sheets

REMOVABLE COMB ATTACHMENT FOR DISPOSABLE RAZORS

BACKGROUND OF THE INVENTION

There are presently three main classes of shaving razors available for sale to the public. The first and oldest class is usually constructed of a solid metallic body that houses a replaceable razor blade. The second class of razors has a similar handle to the first, but the entire head portion, including the razor blade, is replaceable. This class includes razors such as the Gillette® ATRA® brand razor, which has a replaceable tilting head. The third class of razors has the handle, head, and blade incorporated into a single piece of plastic. This design makes the entire unit assembly disposable.

The advent of disposable razors has brought increased convenience to the shaving process. Disposable plastic razors weigh less than the previous, bulky metallic razors, and have alleviated the necessity for disposing of the potentially harmful, unshielded used razor blades. When using a disposable razor, the user never need contact the unprotected cutting edge of a razor blade. In addition, as the number of users shaving with disposable razors has increased, the cost per razor has lowered until it has become almost the same price as purchasing just the disposable razor heads.

As presently available, most disposable razors are sold with a protective cover over the razor head. This cover is designed to protect the user from making inadvertent contact with the razor blade, potentially resulting in injury. As normally sold, each disposable razor has a single cover completely shielding the sharpened edges of the razor from any possible contact with an outer surface. While this is the standard disposable razor package, the cover has been suggested to provide multiple uses. Trotta, U.S. Pat. No. 4,777,722, discloses a disposable razor cover which, when inverted, exposes a polymeric material below the razor blades. The polymeric material is slanted at the same angle as the blades, and would apply a chemical composition onto the skin prior to contact with the blades. The chemical was designed to lower the friction caused by the razor against the user's skin.

It is also known to use razor blades for hand-held devices for trimming and cutting longer hair. Lewis, U.S. 2,234,440 discloses a device which has a handle and a cutting head having permanent comb-like teeth for guiding the hair into the cutting blade. Lewis distinguished his device from conventional shaving razors, since his improvement was specifically constructed to prevent cutting hair close to the skin. The Lewis device could only be used for trimming longer hairs such as those found in a mustache, beard or sideburns.

In the past there have been many improvements on razor technology, however, there still exists a need for an inexpensive way of providing the hair trimming capability of the Lewis razor, while taking advantage of the widespread existing base of disposable razor users.

SUMMARY OF THE INVENTION

A comb attachment for a disposable plastic shaving razor mounts on the shaving head in a manner similar to a conventional protective razor cover. The attachment has a frame portion which slides over, or clips on, the shaving head. Unlike conventional protective covers, an opening in the frame is disposed above the razor blade exposing the blade, and a plurality of spaced, parallel teeth extend over the opening above the blade. When the device is mounted on the razor head, the teeth serve as a guide for directing longer hairs to the blade, and as spacing means for maintaining a desired separation of the blade from the user's skin. The teeth also serve as protective members which preclude accidental contact with the blade as the razor is handled.

The present invention has as an underlying objective the improvement in the previously known removable covers for a razor. The inventive cover has spaced parallel teeth allowing a user to trim body hair such as a mustache, sideburns, or a beard. After trimming hair with the cover in place, the user can remove the cover and shave as normal. This invention incorporates the hair-trimming ability of previous razors with the flexibility to attach and remove the teeth from a standard disposable razor. The present invention thereby provides an inexpensive, reusable means for trimming and cutting hair.

To use the present invention, the comb attachment is mounted on a standard disposable plastic razor, such as that embodied by the Gillette® GOOD NEWS® brand razor. The comb attachment provides the razor with removable teeth preventing the razor blades from directly contacting the skin. In this manner, a user can evenly trim long facial or body hair.

It can be envisioned that teeth on alternate embodiment covers of the present invention might protrude various distances outward from the front of the razor head to trim hair to differing lengths. For instance, teeth protruding smaller distances from the razor head would trim hair closer to the skin, whereas teeth protruding larger distances from the razor head would trim only that hair protruding further from the skin. One of ordinary skill in the art could determine the optimal teeth dimensions for providing the most advantageous comb attachment cover. Any comb-type razor cover having teeth for trimming hair is envisioned to be within the scope of the present invention.

Prior to this invention, users of non-electric razors had to purchase at least two separate shaving devices for trimming hair. One device was used for normal shaving close to the skin, while a second device was necessary to trim longer hair.

The present invention advantageously incorporates a comb into a detachable razor cover. This invention thereby provides several advantages over prior shaving devices. First, the comb attachment enables a conventional disposable plastic razor to be used for hair trimming. In addition, the comb teeth protect the user from inadvertent contact with the blade edge similar to past covers. Also, the cover is removable from the razor allowing its repeated utilization. The reusability of the present invention provides a cost advantage to the user over prior hair trimming devices.

The comb attachment may be used on any blade razor, disposable or permanent, and can attach in any manner. For instance, a comb cover for the Gillette ATRA® razor would be considered within the scope of the present invention. For this reason, the description below of the preferred embodiment should not be considered as limiting the scope of the present invention.

Various other objects, advantages, and features of the present invention will become readily apparent from the ensuing detailed description of preferred embodiments thereof.

Description of a Preferred Embodiment

DESCRIPTION OF A PREFERRED EMBODIMENT

Figure 1:
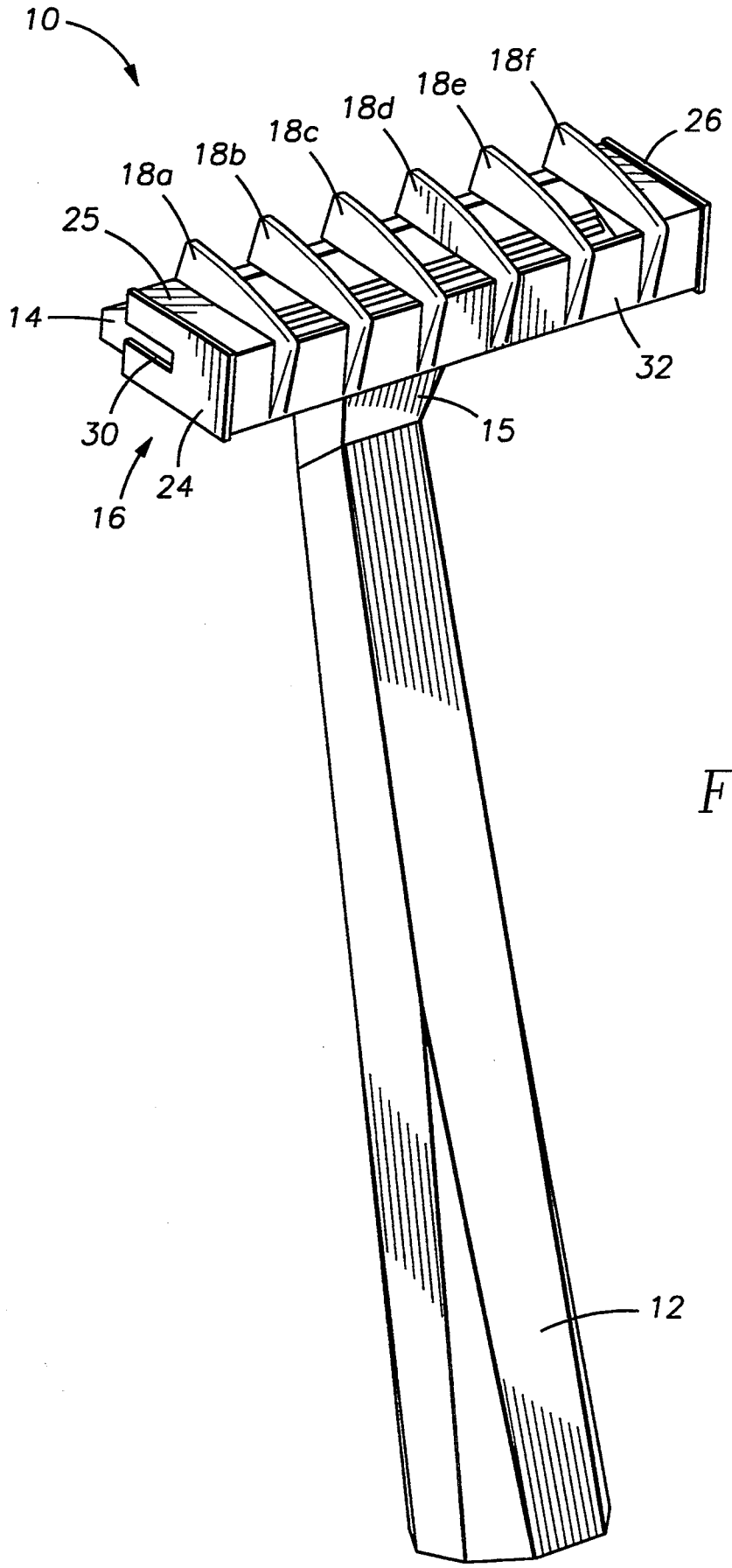
FIG. 1 is a perspective view of the inventive comb cover attached to a disposable razor.
Figure 2:
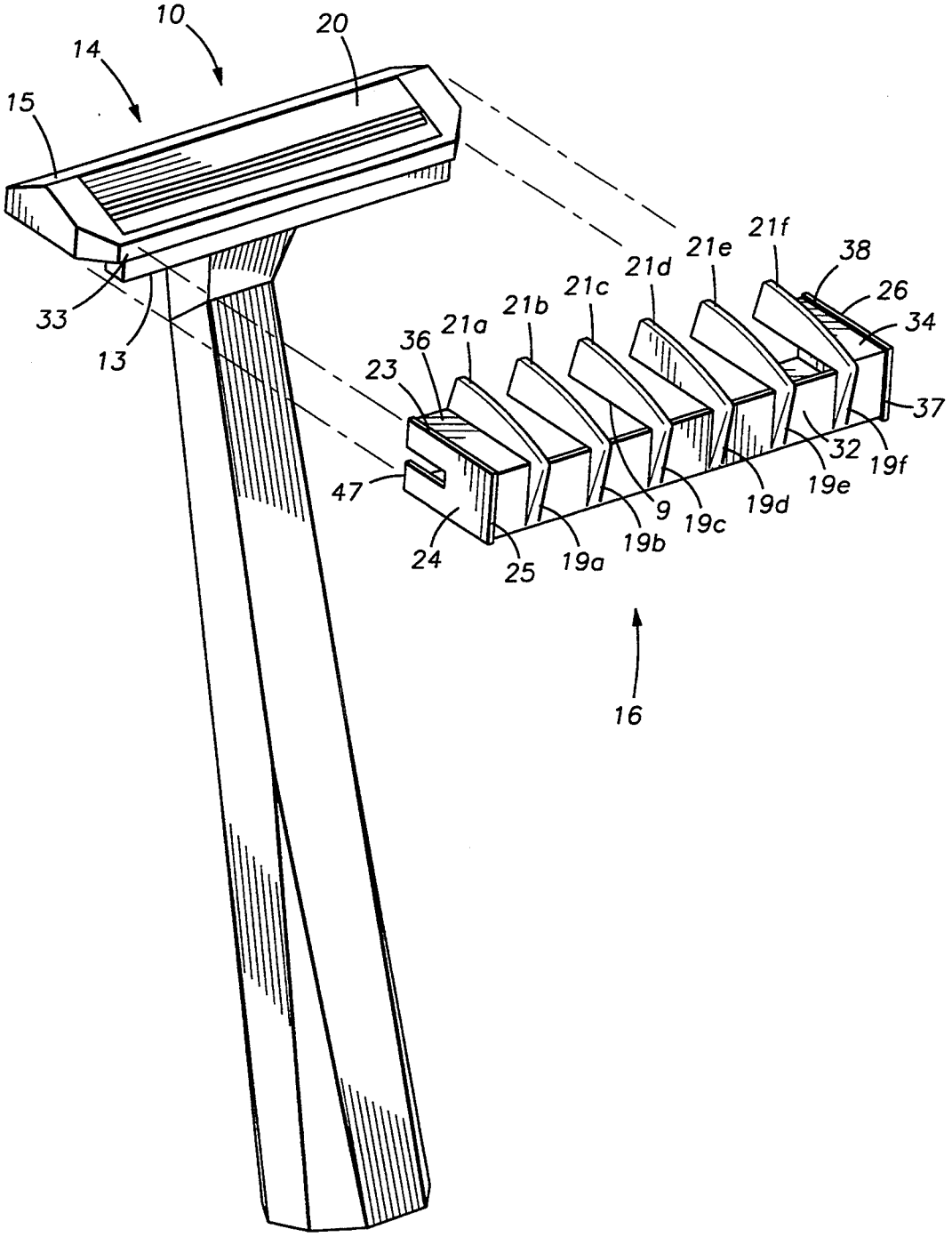
FIG. 2 is an exploded perspective view of the inventive comb cover separated from a disposable razor.

Referring now specifically to FIG. 1, a disposable razor 10 has a handle 12 and a shaving head 14. The handle 12 is rectangular and designed to comfortably fit a user's hand. A forward angled neck 15 is formed at the top of the handle portion 12 for mounting the shaving head 14 in a preferred position. By so mounting, the shaving head 14 of the razor 10 is placed at an angle relative to the handle 12 as to provide a comfortable position for shaving. As shown in FIG. 2, a blade 20 is longitudinally disposed in the razor head 14, providing the cutting surface of the razor 10. A bead 13 extends downwardly along the cover front surface of the razor and engages a series of knobs molded into the comb attachment to form a friction fit of the device to the razor.

Figure 6:
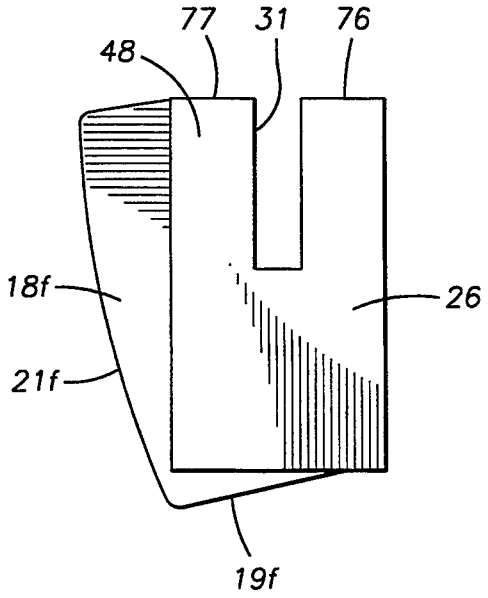
FIG. 6 is an end view of the comb attachment detailing teeth and side notch of the inventive comb cover.

In accordance with the present invention, a removable cover 16 mounts in an interlocking relationship with the razor head 14 as shown in FIGS. 1 and 2. The cover 16 has a left sidewall 24 and a right sidewall 26, with a front wall 32 disposed between the two sidewalls 24, 26. The left sidewall 24 has an upper edge 23, and a forward edge 25. The left sidewall 24 defines the leftmost portion of the cover 16. A notch 30 extends from the center of the left sidewall 24 in the rearward direction to a first trailing edge 47, forming a channel through the left sidewall 24. In a similar fashion, as is illustrated in FIG. 6, the right sidewall 26 has a notch 31 extending from the center of the right sidewall 26 to a second trailing edge 48, also forming a channel in the rearward direction.

During manufacture, the front wall 32 is preferably molded from plastic resin integrally with side walls 24 and 26. Any type of moldable plastic, such as PVC, polystyrene, or polyethylene could be used. The notches 30, 31 are centrally positioned rectangular openings extending from the center of each sidewall to the trailing edges 47, 48. As explained in more detail below, and illustrated in FIGS. 2 and 9, the notches 30, 31 in the sidewalls 24, 26 provide for vertical displacement of the trailing edges 47, 48 relative to one-another. This configuration permits the slidable engagement of the razor head 14 into the removable cover 16.

Figure 3:
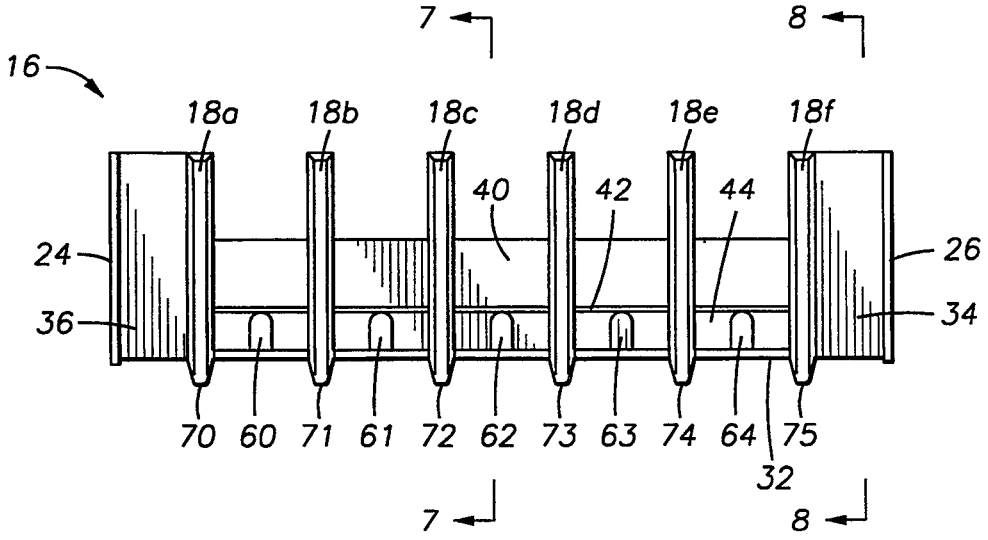
FIG. 3 is a top plan view of the comb attachment, illustrating the comb teeth and upper side plates.
Figure 4:
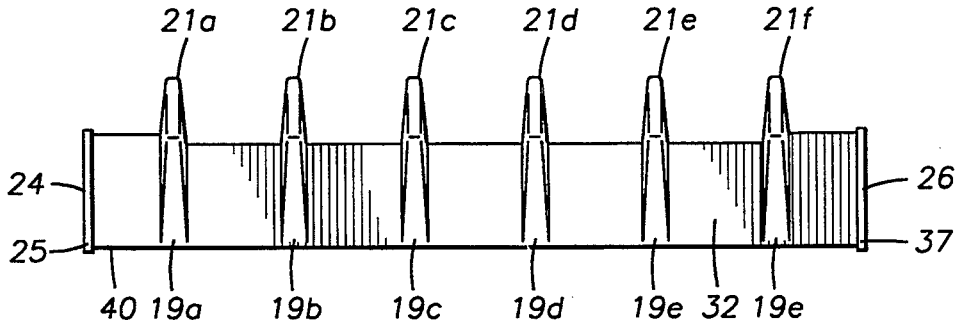
FIG. 4 is a front elevational view of the comb attachment illustrating the forward edges of the teeth.

The front wall 32 of the removable cover 16 has a plurality of evenly spaced, parallel comb teeth 18 *a*, 18 *b*, 18 *c*, 18 *d*, 18 *e*, 18 *f* (hereinafter denoted "18(*a–f*)") as shown in FIGS. 1, 2, and 3. The plurality of teeth 18 (*a–f*) have a corresponding plurality of leading edges 19 (*a–f*) and a plurality of trailing edges 21(*a–f*). The leading edges 19(af) of the teeth 18 (*a–f*) perpendicularly project from the plane of the front wall 32, with a slight forward cant, while the trailing edges 21 (*a–f*) rearwardly arch from the forwardmost position of the teeth 18 to become substantially parallel to the top of the razor head 14, when attached to the removable cover 16. This positioning provides the desired spacing of the blade 20 from a users skin and also protects unwanted contact with the partially shielded blade 20. The end teeth 18 *a* and 18 *f* are molded to the top wall panels 34 and 36, and the remaining teeth are attached only at the cross-panel 32 of the frame.

Figure 8:
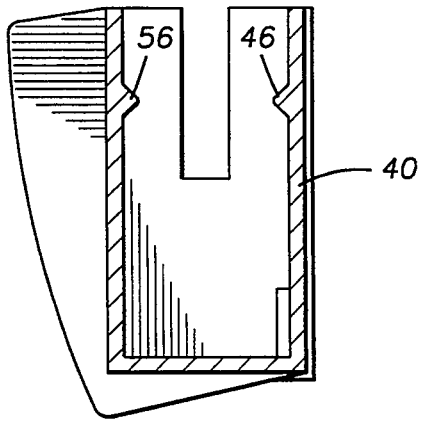
FIG. 8 is an elevation view in cross-section, taken along line 8—8 of FIG. 3.
Figure 7:
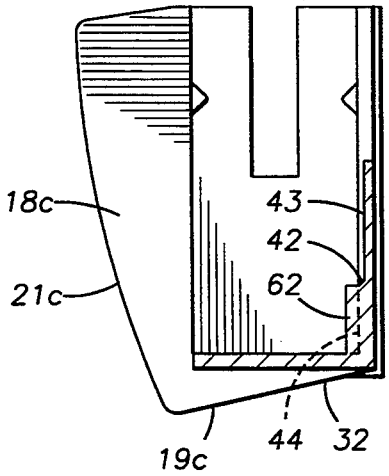
FIG. 7 is an elevation view in cross-section, taken along line 7—7 of FIG. 3.

As illustrated in FIG. 2 and discussed above, the comb teeth 18 (*a–f*) form L-shaped protrusions, each with the forward edges 19 (*a–f*) intersecting and attaching to the front wall 32, and the rearward edges 21 (*a–f*). The forward and the rearward edges 19 (*a–f*), 21 (*a–f*) meet and define corners 70, 71, 72, 73, 74, 75, as best illustrated in FIGS. 3, 7, and 8. The forward edges 19 (*a–f*) are principally structural beads and have little function in the hair-trimming process. During use, the rearward edges 21 (*a–f*) of each tooth 18 (*a–f*) keep the user's skin a preferred distance from the blade 20. Preferably, the upper surface of the rearward edges 21 (*a–f*) is slightly curved to provide a smooth point of contact with the user's skin when shaving. The comb teeth 18 project least above the surface of the removable cover 18 at the corners 70, 71, 72, 73, 74, 75, and gradually increase towards the farthest rearward edge. Such a tooth configuration provides an even trimming of the hair. To most easily guide the hair to the blade, the teeth should be substantially perpendicular to the blade.

The dimensions of the cover and the comb teeth depend in part on the configuration of the razor and are well within the capability of those skilled in the art. The purpose of the teeth is to guide hair to be trimmed to the blade, but to maintain an adequate spacing between the blade and the skin to preclude cutting the hair too short. The frame of the cover is designed to fit over the shaving head without increasing the overall dimension of the razor substantially, thus avoiding packaging inefficiencies. In general, the comb teeth average from about 1/16" to about $\frac{1}{4}$" in height, preferably about $\frac{1}{8}$", and may vary in height along its length. As shown in the drawings, the teeth may be lower in height at the front of the attachment, gradually increasing in height along their length. The length of the teeth may also vary, usually ranging from $\frac{1}{2}$" to $\frac{5}{8}$", preferably about $\frac{3}{8}$" to $\frac{1}{2}$". The bottom edge of the teeth should be very close to the blade(s) without making actual contact, thus possibly damaging the blade. The bottom of the teeth are preferably less than 1/16" still more preferably less than 1/32" above the blade.

The outer teeth 18 *a* and 18 *f* are attached to the sidewalls 24, 26 by a pair of upper side panels 34, 36, as is illustrated in FIG. 3. The upper side panels 34, 36 are positioned horizontally and provide lateral stability to the outer teeth 18 *a*, 18 *f*. In addition, as is explained in more detail below, the upper side panels 34, 36 assist the detachable engagement of the cover 16 to the razor head 14. The central teeth 18 *b*, 18 *c*, 18 *d*, 18 *e* only attach to the inventive cover 16 at the front wall 32.

As is also shown in FIG. 3, a rectangular base panel 40 longitudinally extends between the side walls 24, 26, and in a perpendicular orientation to the front wall 32. A forward edge 42 of the lower panel 40 is thicker than a thinner, rearward edge 43 (See FIG. 7) and has a plurality of semi-circular knobs 60, 61, 62, 63, 64, which engage the lower lip or bead 13 on the razor, evenly disposed along the juncture of the front wall 32 and the lower panel 40. The semi-circular knobs 60, 61, 62, 63, 64 are located between the mounting positions of the teeth 18(*a–f*). Running longitudinally between the thinner edge 43 and thicker edge 42 of the lower panel 40 is a forward slanted ridge 44. This ridge provides the transition from the thinner edge 43 to the thicker edge 42 of the lower panel 40. The cross-sectional, elevational view of the cover 16 shown in FIG. 7 illustrates the relationship between the thinner section 43 and thicker section 42 of the lower panel 40. These features are generally conventional or commercially available disposal razor covers.

Figure 5:
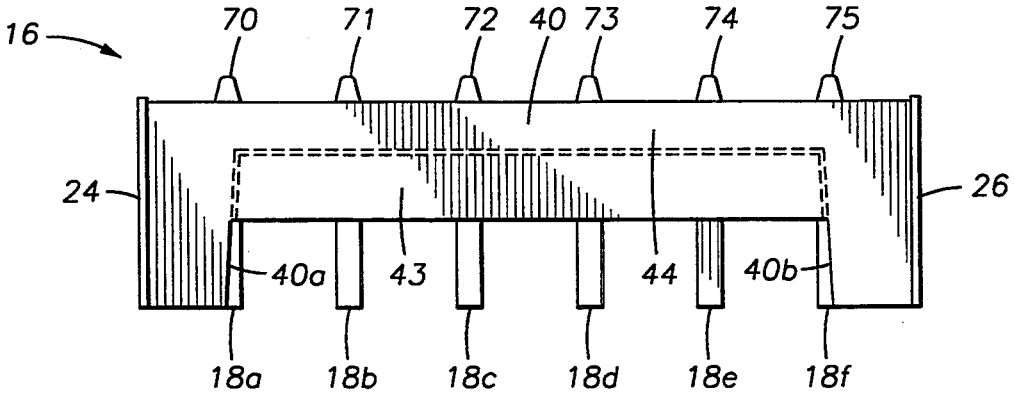
FIG. 5 is a bottom plan view of the comb attachment illustrating the lower panel.

As illustrated in FIG. 5, a bottom view of the cover 16, it can be appreciated that the thinner edge 43 only covers a portion of the lower panel 40. The thicker edge 42 of the lower panel 40 extends along both ends and one lateral side of the thinner edge 43. As also can be appreciated by the bottom view, the rearward edges 21(*a–f*) of the teeth 18(*a–f*) protrude from behind the thinner edge 43 of the lower panel 40. Likewise, the leading edges 19(*a–f*) of the teeth 18(*a–f*) are evident, extending slightly in front of the leading edge of the base panel 40. In a preferred embodiment, the teeth extent in front of the leading edge of the base panel by at least 1/16", preferably at least 150".

The interengaging fastening means on the cover and razor are identical to those used commercially on the BIC Shaver disposable razor but will be described herein. As more particularly illustrated by FIG. 6, a left side view of the preferred embodiment cover 16, the left notch 31 in the side panel 26 creates a means for a first engagement tab 76 and a second engagement tab 77 to move away from one another during engagement of the razor head 14 into the cover 16. Protruding above and forward of the right side wall 26 is the tooth 18*f* having a rearward-facing trailing leg 21*f*, and forward, leading edge 19*f*.

Figure 9:
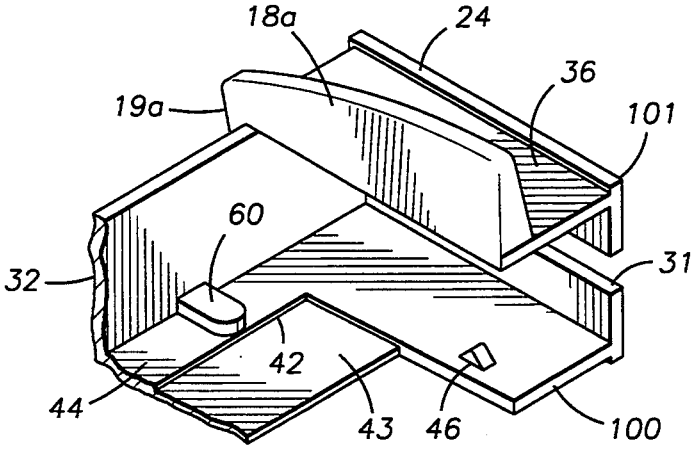
FIG. 9 is a fragmentary sectional perspective view of one end of the comb cover illustrating the engagement tabs and side notch.

As illustrated in FIGS. 8 and 9, an upper engagement tab 46 and a lower tab 56 are disposed on the inner surfaces of the right upper side panel 36 and base panel 40, respectively. The engagement tab 46 slidably engages groove 15 in the razor head 14. Tab 56 simply serves as a guide when the razor head is pressed into sliding engagement with the frame. These features are conventional. It can be appreciated that the left upper side panel 34 also has an upper engagement tab (not shown) formed on its inner surface in a similar fashion to the engagement tab 46 disposed on the inner surface of the right upper side panel 36.

FIG. 8 is a cross-sectional view of one end of the removable cover 16. This view clearly illustrates the rectangular orientation of the upper side plate 36, front wall 32, and lower panel 40, which together form a cavity to receive and mount the razor head 14.

During engagement of the razor head 14 into the comb cover 16, a front edge 33 (FIG. 2) of the razor 10 is placed inside the cavity formed in the cover 16 by the sidewalls 24, 26, the upper side panels 34, 36, the front wall 32, and the base panel 40. As can be envisioned by the view shown in FIG. 9 of the attachment mechanism, the front wall 33 (now shown in FIG. 9) is pressed forward into the cavity formed by the side panel 36, the front wall 32, and the lower panel 40, until the front wall 33 makes contact with the engagement tabs 46, 56 (also see FIG. 8). Further relative forward movement between the razor 10 and the cover 16 forces the head 14 between the engagement tabs 46, 56 causing the first and second engagement tabs 76, 77 to move apart from one-another. Once the razor head 14 is positioned substantially within the cavity of the cover 16, the engagement tabs 46, 56 seat into corresponding recesses on the upper and lower surfaces of the razor (not shown).

Once the razor head 14 is firmly seated, the engagement tabs 46, 56 prevent the cover from being inadvertently dislodged from the head 14. It can be appreciated that upper and lower engagement tabs similar to the engagement tabs 46, 56 are disposed on the opposite side of the cover 16, and likewise assist in reversibly attaching the head 14 to the cover 16.

In the embodiment shown in FIGS. 1 and 2, the side walls 24 and 26, the front panel 32, and the two top panels 36 and 38 comprise a frame or housing which slides over and engages the shaving head. The interengaging fastening means on the shaving head and on the trim attachment, as described in detail herein, retain the attachment immovably on the razor such that accurate hair trimming can take place without fear of movement of the comb teeth.

Unlike conventional razor covers, which cover the entire razor blade to preclude any contact whatsoever with the blades until the cover is removed, the trim attachment has an opening formed by frame members to allow contact between the blades and the hair desired to be trimmed. As shown in FIG. 2, a U-shaped opening 9 in the frame is defined by the upper edge of front panel 32 and the lower inside edges of teeth 21*a* and 21*f*. The teeth extend rearwardly from the front panel 32 of the frame, above and transverse to the blade, exposing the blade to hair to be trimmed.

The function of the frame or housing is simply to attach rigidly and releasably to the shaving head, and to carry the teeth. Thus, the frame can be designed in many ways to provide these functions. For example, the teeth could be mounted on a bar or panel which extended between rear portions of the side walls of the frame, leaving the front portion of the frame more open. Thus, rather than attaching the trimming device to the shaving head by sliding the head into the device (as is common with commercial covers as shown in the drawings), the device could clip on to the top of the shaving head. Again, the particular type of releasable fastening means depends in part on the razor design and is well within the skill of the art.

Figure 10:
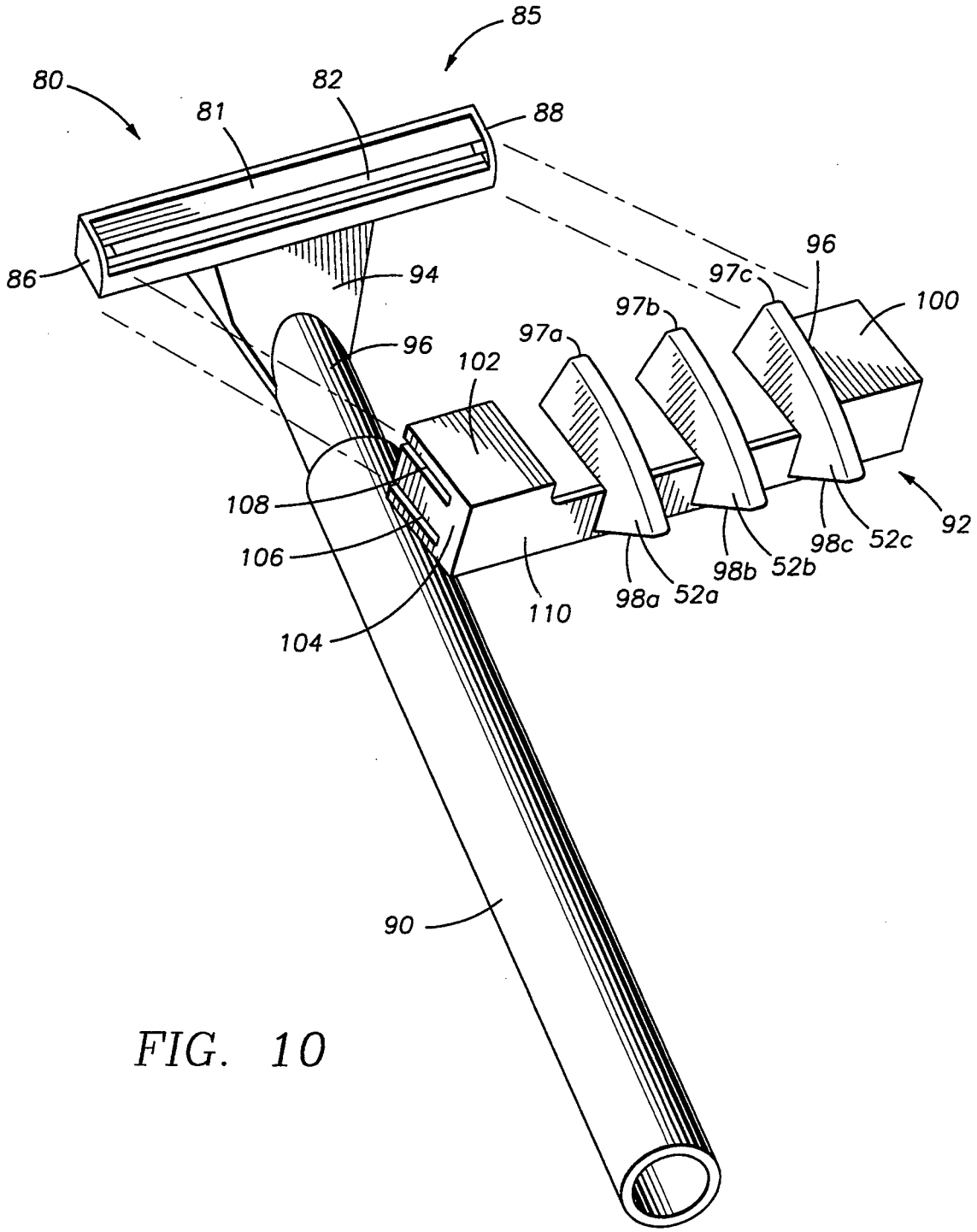
FIG. 10 is an exploded perspective view illustrating an alternate embodiment of the comb attachment wherein only three teeth protrude from the razor cover.

In addition to the preferred embodiment discussed above, other embodiments of the present invention are also anticipated. One of ordinary skill in the art could design many different embodiments of the present invention wherein the engagement means was specifically designed to correspond to or interact with a particular razor design. In addition, the number and shape of the teeth could be optimized for the particular razor and type of trimming desired. One alternate embodiment is illustrated in FIG. 10, a perspective view of a multi-blade razor 80 and a comb cover 92 having only three teeth 52*a*, 52*b*, 52*c* attached to a front panel 110 of the cover 92. In a similar manner to the preferred embodiment, the cover 92 has upper side panels 100, 102, and side walls 104, 105 connected to the front panel 110. The side walls 104, 105 define the left and right portions of the cover 92. The cover 92 is shown in FIG. 10 as being attached to a razor 80. The razor has a mostly cylindrical lower handle portion 90 and an upper cylindrical handle portion 96. The upper handle portion 96 attaches to a neck 94 at a preferred angle to provide a comfortable grip while shaving. The top of the neck 94 attaches centrally to a mostly rectangular razor head 85, and has side panels 86, 88 disposed on the outer edges of a set of offset blades 81, 82. A pair of dual side notches 106, 108 allow the cover 92 to mount over the head 85 of the multi-blade razor 80 by permitting the side panel 102 to flex in the vertical direction, and removably engage the head 85. A set of three rearward trailing edges 97*a*, 97*b*, 97*c* and a set of three forward leading edges 98*a*, 98*b*, 98*c* of the teeth 52*a*, 52*b*, 52*c* provide the combing and trimming capability similar to that of the preferred embodiment.

The device of the invention is easily used independently of, or in conjunction with, the normal shaving process. A user selects a disposable razor, removes the conventional cover (if one is provided), and shaves his beard normally. Following shaving, the user attaches the comb device to the razor such that it does not move on the shaving head and draws the device over the hair to be trimmed. Following completion of the trimming process, the razor can be stored with either the original cover or the trimming device in place. Alternatively, the user can shave after the hair-trimming process. Since the trimming attachment of the invention can be produced by injection molding very inexpensively, the device can be substituted for the normal razor cover and all razors can be sold with the trimming device in place.

Although the preferred embodiment of the present invention has six teeth, and an alternate embodiment having three teeth is disclosed, any number of teeth is anticipated by the present invention. It is also anticipated that other embodiments of detachable comb covers for razors are within the scope of the present invention. For instance, a cap having only two teeth, or up to ten teeth would be within the purview of the present invention; from three to six teeth is preferred. In addition, various modifications of the frame design are contemplated, and any type interengaging fastening means for attaching the comb device to the shaving head may be used. While the invention has been described with respect to a specific embodiment thereof, it will be immediately apparent to those skilled in the art that modifications may be made within the spirit and scope of the invention. Accordingly, the invention should not be limited with respect to the specific embodiment disclosed herein, but rather should be defined only by the following claims.

I claim:

1. A hair-trimming attachment for a disposable shaving razor, said disposable shaving razor having a handle, a shaving head, and at least one razor blade mounted in the shaving head, said razor blade having a cutting edge, a first side facing said handle, and a second side facing away from said handle, said attachment comprising a frame adapted to removably mount on the shaving head of the disposable shaving razor, an opening in an upper portion of the frame exposing the second side and the cutting edge of the razor blade when the frame is mounted on the shaving head, a plurality of spaced, parallel teeth extending from the frame across the opening and perpendicular to the razor blade to partially cover the cutting edge and the second side of the razor blade, and mounting means for releasably attaching the frame to the shaving head, such that hair may be cut by said cutting edge while said frame is attached to said razor.

2. The hair-trimming attachment of claim 1 wherein the frame has from three to ten teeth.

3. The hair-trimming attachment of claim 1 in which the frame has from three to six teeth.

4. The hair-trimming attachment of claim 1 in which the teeth mount perpendicular to the razor blade.

5. The hair-trimming attachment of claim 1 wherein the teeth average from about 1/16" to ¼" in height and mount less than 1/16" above the blade.

6. The hair-trimming attachment of claim 1 wherein bottom edges of the teeth are elevated less than about 1/32" above the blade.

7. The hair-trimming attachment of claim 1 having from two to ten teeth wherein the attachment is a single piece molded from plastic.

8. The hair-trimming attachment of claim 1 wherein the frame has opposed sidewall portions adapted to enclose opposing end walls of the shaving head, and a front panel connecting said sidewalls, and wherein the teeth extend rearwardly from the front panel.

9. The hair-trimming attachment of claim 1 wherein the teeth have a smooth upper face-engaging surface.

10. The hair-trimming attachment of claim 1 for a shaving razor having a disposable shaving head.

11. A device for preventing accidental contact with a blade of a safety razors's shaving head comprising the hair trimming device of claim 1.

12. A method of preventing accidental contact with a blade of a safety razor's shaving head comprising the step of attaching the hair-trimming attachment of claim 1 to the shaving head.

13. In combination, a disposable shaving razor having a handle, a shaving head at one end of the handle and at least one razor blade mounted in the shaving head said razor blade having a cutting edge, a first side facing said handle, and a second side facing away from said handle, and a hair-trimming attachment adapted to mount detachably on the shaving head of the disposable shaving razor comprising a frame having end portions and a connecting member between the end portions, an opening in the frame exposing the second side and the cutting edge of the razor blade, and a plurality of spaced, parallel teeth extending from the frame across the opening substantially perpendicular to the razor blade to partially cover the cutting edge and the second side of the razor blade, and interengaging fastening means on the shaving head and the hair-trimming attachment for releasably attaching the hair-trimming attachment to the shaving head, such that hair may be cut by said cutting edge while said frame is attached to said razor.

14. The hair-trimming attachment of claim 13 wherein the teeth average from about 1/16" to ¼" in height and mount less than 1/16" above the blade.

15. The hair-trimming attachment of claim 13 having from two to ten teeth wherein the attachment is a single piece molded from plastic.

16. The hair-trimming attachment of claim 13 wherein the frame has opposed sidewall portions adapted to enclose a opposing end walls of the shaving head, and a front panel connecting said sidewalls, and wherein the teeth extend rearwardly from the front panel.

17. The combination of claim 13 wherein the shaving razor comprises two razor blades mounted in parallel in the shaving head.

18. The hair-trimming attachment of claim 13 wherein the teeth have a smooth upper face-engaging surface.

19. The hair-trimming attachment of claim 13 wherein the frame has from three to ten teeth.

20. The hair-trimming attachment of claim 13 in which the frame has from three to ten teeth.

21. The hair-trimming attachment of claim 13 in which the teeth mount perpendicular to the razor blade.

22. A method of trimming hair using a disposable safety razor, said disposable safety razor having a handle, a shaving head mounted at one end of the handle, and at least one razor blade mounted in the shaving head said razor blade having a cutting edge, a first side facing said handle, and a second side facing away from said handle, said method, comprising, mounting a detachable trim attachment over the shaving head of said disposable safety razor, said trim attachment comprising a frame having end portions, a connecting member extending between the end portions, an opening exposing the second side and the cutting edge of the razor blade, and a plurality of spaced, parallel teeth extending from the connecting member across said opening and perpendicular to said blade to partially cover the cutting edge and the second side of the razor blade, maintaining the trim attachment immovably on the shaving head, drawing the shaving head of said disposable safety razor with the trim attachment in place over the hair to be trimmed in a manner such that the teeth guide the hair to the blade, thereby cutting said hair, and removing the trim attachment from the shaving head.

23. The method of claim 22 which also comprises the step of using the shaving head to shave a user's beard prior to mounting the trim attachment onto the shaving head.

24. The method of claim 22 which also comprises the step of shaving a user's beard subsequent to mounting the trim attachment onto the shaving head.

25. The method of claim 22 wherein the trim attachment comprises from three to ten teeth mounted less than about 1/32" above the razor blade, said teeth being aligned substantially perpendicular to the razor blade, said teeth being an average of from about 1/16" to ¼" in height.

* * * * *